United States Patent [19]

Wong

[11] 4,126,523

[45] Nov. 21, 1978

[54] METHOD AND MEANS FOR ELECTROLYTIC PRECLEANING OF SUBSTRATES AND THE ELECTRODEPOSITION OF ALUMINUM ON SAID SUBSTRATES

[75] Inventor: Jack Y. Wong, San Jose, Calif.

[73] Assignee: Alumatec, Inc., Lompoc, Calif.

[21] Appl. No.: 792,315

[22] Filed: Apr. 29, 1977

Related U.S. Application Data

[63] Continuation-in-part of Ser. No. 734,677, Oct. 21, 1976, and a continuation-in-part of Ser. No. 734,679, Oct. 21, 1976.

[51] Int. Cl.[2] ..... C25D 3/44; C25D 5/34

[52] U.S. Cl. ..... 204/32 R; 204/14 N; 204/141.5

[58] Field of Search ..... 204/14 N, 32 R, 33, 204/141.5, 144.5

[56] References Cited

U.S. PATENT DOCUMENTS

| | | | |
|---|---|---|---|
| 2,170,375 | 8/1939 | Mathers et al. | 204/14 N |
| 2,873,233 | 2/1959 | Schnable | 204/32 R |
| 3,699,013 | 10/1972 | Miyata | 204/32 R |
| 3,969,195 | 7/1976 | Dotzer et al. | 204/14 N |
| 3,997,410 | 12/1976 | Gileadi et al. | 204/14 N |

OTHER PUBLICATIONS

The Electrochemical Society Pre-print 65-2, published Apr. 30, 1934.

*Primary Examiner*—T. M. Tufariello
*Attorney, Agent, or Firm*—I. Morley Drucker

[57] ABSTRACT

Adherent deposits of aluminum can be obtained on metallic substrates by anodic etching of the substrates (reverse current electrolytic cleaning) employing a novel etch solution made as follows:

1. reacting a sufficient amount of aluminum with a hydrogen halide such as HCl, HBr, or HI (preferably hydrogen bromide) in an organic solvent such as benzene or toluene (and in the absence of water) to form a solution in which the concentration of the dissolved aluminum is from 2.0 M to 3.5 M; and
2. then adding hydrogen halide to the resulting solution of 1) above such that the hydrogen ion concentration of the said resulting solution is greater than 1.0 M but below the saturation point of hydrogen halide in said solution.

Prior to the actual plating operation, the novel etch solution just described is directed to a plating chamber wherein the metallic substrate is electrocleaned by reverse current anodic etching, i.e., the substrate becomes the anodic terminal of the cell, the reverse of its electric potential in normal electroplating. Then the electroplating electrolyte is directed to the plating chamber to flush out the etch solution. Finally, fresh electroplating electrolyte is directed to the plating chamber for electroplating of the substrate, which is now rendered cathodic.

14 Claims, 1 Drawing Figure

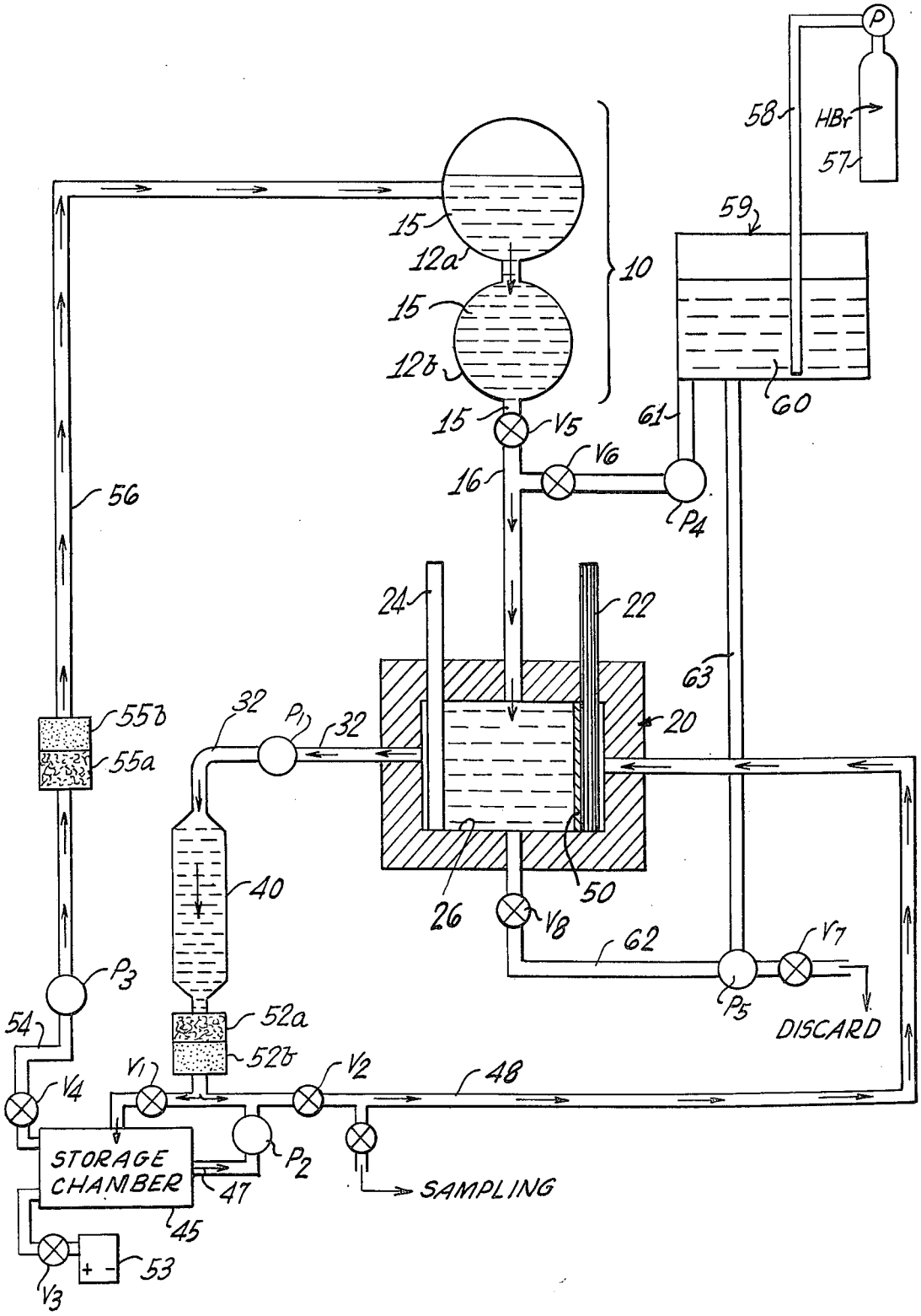
P
58
HBr
57
59
15
12a
10
15
12b
60
15
V5
61
V6
16
P4
56
24
22
63
55b
32
P1
32
20
55a
40
26
50
V8
62
V7
P3
P5
DISCARD
54
52a
52b
V1
V2
48
V4
STORAGE CHAMBER
P2
47
SAMPLING
45
53
V3

METHOD AND MEANS FOR ELECTROLYTIC PRECLEANING OF SUBSTRATES AND THE ELECTRODEPOSITION OF ALUMINUM ON SAID SUBSTRATES

CROSS REFERENCE TO RELATED APPLICATIONS

This application is a continuation-in-part of the following copending patent applications:

1. Serial No. 734,677, entitled "ELECTROPLATING SOLUTIONS FOR THE ELECTRODEPOSITION OF ALUMINUM AND METHOD OF MAKING SAME", filed Oct. 21, 1976, Jack Yea Wong, Inventor; and
2. Serial No. 734,679 entitled "METHOD OF ELECTROPLATING ALUMINUM AND ITS ALLOYS" filed Oct. 21, 1976, Jack Yea Wong, Inventor.

BACKGROUND OF THE INVENTION AND PRIOR ART

1. Introduction

In my studies on the electrodeposition of aluminum, I have discovered that the conventional methods of cleaning the substrate before plating, such as ultrasonic cleaning, the use of various alkaline cleaners, the use of various acid cleaners, and electropolishing in aqueous baths, followed by an aqueous rinse cycle and dry cycle yield adequate deposits of adherent aluminum onto certain steel alloys, or certain noble metals. However, if the substrate is titanium, tantalum or certain nickeliron alloys such as Kovar and Alloy 42, the application of the above techniques results in deposits of aluminum that have only low adherence to the substrates. Hence, there is a need for a novel etch solution that would activate these and other metal surfaces such that once these surfaces are etched, electrodeposition of adherent aluminum may proceed immediately - without exposing these etched surfaces to air or aqueous media by going through a rinse cycle just prior to plating.

2. Prior Art

Anodic etching techniques or reverse current electropolishing methodsare, broadly speaking, not new (1, 2, 3, 4, 5)*. The most commonly used electropolishing baths are, however, based upon the use of sulfuric and phosphoric acids and these electropolishing baths are found not to be effective in the electrodeposition of aluminum onto the substrates above mentioned. The major disadvantage of utilizing these baths in the precleaning of the particular metallic substrates listed above for aluminum plating is that immediately after the metallic substrate is etched, an additional aqueous rinse step and a drying step are necessary before plating can proceed. These rinse and dry steps are necessary not only to remove traces of etch solution adhering to the surface of the substrate in question, but also to prevent the sensitive electroplating solution (which is preferably non-aqueous) from being contaminated with the aqueous etch solution. Thus, an oxide layer usually reappears on the supposedly "cleaned" surface of the substrate, which gives non-adherent deposits of aluminum. So far as we are aware, no prior art has been developed or reported involving the use of organic etch baths, or other electropolishing solutions, that will produce adherent aluminum deposits upon plating onto the particular metal substrates cited above.

*(1) C. L. Faust, J. Electrochem, Soc. 75, 62c (1949) (2) C. L. Faust, Proc. Am Electroplat, Soc. 137 (1950) (3) C. L. Faust, Met. Prog. 71(5), 101 (1957) (4) C. L. Faust, "Metal Finishing Guidebook - Directory" Metals and Plastics Publication, Westwood, N. J. (Annual) (5) A. K. Graham, Ed., "*Electroplating Engineering Handbook*" 3rd Ed., Van Nostrand Reinhold, Princeton N. J. (1971)

BRIEF DESCRIPTION OF THE DRAWINGS

The FIGURE is a schematic representation of an apparatus for both electropolishing a metallic substrate, utilizing the novel etch solution of this invention, and thereafter, electroplating the precleaned substrate.

SUMMARY OF THE INVENTION

This invention is directed to an improved method and means for the pre-cleaning of metallic substrates to subsequently enable a more adherent electroplating of aluminum onto a metallic substrate such as titanium, tantalum and certain nickel-iron alloys such as Kovar and Alloy 42, and others.

Highly adherent deposits of aluminum can be obtained on such metallic substrates by the anodic etching of the substrate (reverse current electrolytic cleaning) with the utilization of an etch solution, made as follows:

1. reacting a sufficient amount of aluminum with a hydrogen halide such as HCl, HBr, or HI (but preferably hydrogen bromide) in the absence of water, but in an organic solvent, such as benzene or toluene, to form a solution in which the concentration of the dissolved aluminum is from about 2.0M to about 3.5M; and
2. then adding a hydrogen halide to the above solution such that the hydrogen ion concentration of the resulting solution is greater than 1.0M but wherein the hydrogen halide is below the saturation point of said solution.

Prior to the actual plating operation, the novel etch solution of this invention is directed to a plating chamber where the metallic substrate is electrocleaned by reverse current anodic etching, i.e., the substrate becomes the anodic terminal of the cell, the reverse of its electrical potential in normal electroplating. Then, an electroplating electrolyte is directed to the plating chamber to flush out the etch solution. Finally, fresh electroplating electrolyte is directed to the plating chamber for electroplating of aluminum onto the substrate, which is rendered cathodic during the actual electroplating phase of the process. No rinsing and/or drying step is required after the reverse current anodic etch.

DETAILED DESCRIPTION OF THE PREFERRED EMBODIMENT OF THE INVENTION

Electropolishing with the etch solution of this invention is an excellent method of preparation of metal substrates such as titanium, tantalum, and certain nickel-iron alloys (Kovar and Alloy-42) for the electroplating of aluminum thereon. The novel electropolishing bath (etch bath) of this invention is prepared as follows:

a. reacting a given quantity of aluminum with a hydrogen halide such as HCl, HBr, or HI (but preferably hydrogen bromide) in the absence of water, but in one of the following single organic, non-Lewis base solvents or mixtures thereof: Benzene, toluene, carbon disulfide, cyclohexane, dimethyl sulfide, tetrahydrofuran, diiodoethane, toluenecyclohexane (1:1), benzene-cyclo-hexane (1:1), tetrahydrofuran (THF): benzene (4:1) and toluene-$CS_2$ (3:1) to form an intermediate organic solution in which the concentration of dissolved aluminum is from about 2.0M to about 3.5M; and b. then adding to the above intermediate solution, a hydrogen halide such that the hydrogen ion concentration of the resulting solution is at least about 1.0 M but below the saturation level of the hydrogen halide.

In anodic etching (reverse current electrolyticcleaning), the halide (preferably bromide) ion of the etch solution is the driving force. Bromine is generated at the substrate (anode) solution interface. The bromide evolution gives mechanical agitation at the metal surface, assists in dislodging the oxide from the anode, and at the same time brings up fresh cleaning solution. In addition, it is believed that the bromide ion reacts with any oxide of the metallic substrate to form a soluble metal bromide salt. While this is happening, hydrogen is liberated at the cathode.

For the foregoing reasons, the concentration limits of the hydrogen halide appear to be critical. The concentration of hydrogen halide is measured by means of the hydrogen ion $[H^+]$ concentration. The presence of at least about 1.0M $[H^+]$ concentration up to the saturation level of the hydrogen halide is necessary for excellent cleaning of the substrate. Etch baths that have a hydrogen ion concentration below about 1.0M result in non-adherent aluminum deposits, especially on metallic substrates of the type described above.

It is to be noted that the foregoing concentration limits of $[H^+]$ concentration are substantially higher than the uppermost $[H^+]$ limit required by the electroplating solutions of my copending applications Ser. No. 734,677 and 734,679.

Also, in contrast to the aluminum plating solutions described in copending applications Ser. No. 734,677 and 734,679, the concentration of aluminum cationic species in the etch solution should be kept as low as possible in order to hold the viscosity down, and preferably below 3.5M of $[Al^{+3}]$. The low viscosity solution not only is more economical, but also is easier to handle as problems of pumping a viscous solution to the precleaning chamber or zone do not arise. However, it has been found that at least 2.0M aluminum cationic species cation, measured as $[Al^{+3}]$ in solution is required to maintain the high concentration of hydrogen halide (the active species) in solution. Since hydrogen halides by themselves are not very soluble in the organic solvents here utilized, the major role of aluminum halide is to associate or loosely bond, in some manner, with the hydrogen halide, thereby acting to hold the hydrogen halide in solution.

Referring now to the FIGURE, the just-referred to etch batch is prepared in a reaction zone 59. The reaction zone 59 includes one or more vessels in which the basic reagents aluminum, an organic solvent, and a halide source 57 have been thoroughly mixed and reacted, as above-described, to form the fresh electropolishing or etch batch 60 of this invention.

Before the actual electrodeposition of aluminum proceeds, the fresh etch solution 60 is transferred by a pump P4 via line 61, through valve V6, into the plating chamber 26 of the electrolytic cell 20. Then the substrate 22 is electropolished by reversed current anodic etching, i.e., the substrate 22 becomes anodic and terminal 24 of the cell 20 becomes cathodic, the reverse of that of normal electroplating.

Throughout the plating cycle, hydrogen bromide from source 57 is bubbled continuously into the etch solution 60 via line 58 in order to maintain the high hydrogen bromide concentration of the etch solution at 1.0M or higher.

After the anodic substrate 22 has been thus activated, the etch solution in the plating chamber 26 is withdrawn by pump P5, via lines 62 and 63, through valve $V_8$ back into the storage vessel 59.

With valve $V_5$ opened, fresh plating electrolyte 15 is transferred to the plating chamber 26 via line 16 to flush out the remaining etch solution in the plating chamber 26. This is important because the equilibrium of the plating solution may be altered if there is sufficiently high hydrogen bromide concentration etch solution remaining in the plating chamber. Then this wash solution is evacuated from the plating chamber in two ways: the solution may be re-circulated back by pump P5, via lines 62 and 63, to the reaction zone-storage vessel 59 where the etch bath can be rejuvenated on treatment with hydrogen halide from source 57 via line 58. Alternatively, of course, the wash solution could be discharged through valves $V_8$ and $V_7$ and discarded.

Finally, with valve $V_5$ opened fresh electroplating electrolyte 15 is transferred from reaction zones **12*a* and 12*b* via line 16 into the plating chamber 26**. Then the various types of electroplating solutions and cycles may proceed as described in may pending patent applications, Ser. No. 734,677 and Ser. No. 734,679, incorporated herein by this reference, and briefly described below.

The electroplating solution preferably utilized after the etch procedure is made as follows:

a. reacting aluminum with a hydrogen halide such as HCl, HBr, or HI (but preferably hydrogen bromide) or reacting aluminum with a halogen such as $Cl_2$, $Br_2$, or $I_2$ (but preferably bromine), in the absence of water, but in one of the following single organic, non-Lewis base solvents or mixtures thereof: benzene, toluene, carbon disulfide, cyclohexane, dimethyl sulfide, tetrahydrofuran, diiodoethane, toluene-cyclohexane (1:1), benzene-cyclohexane (1:1), tetrahydrofuran (THF): benzene (4:1) and toluene-$CS_2$ (3:1) to form an intermediate aluminum halide cation in solution, the concentration of the aluminum cation and the concentration of hydrogen ion, in solution being respectively, below about 7.5M and 0.5M and preferably being, respectively, below about 4.2M and 0.1M; and b. then adding a restricted amount, preferably less than about 16 mole % relative to the initial quantity of aluminum added, of a metal halide MX, where M=Li, Na, or K and X=Cl, Br, or I; or where MX is a special halide such as beryllium bromide, magnesium bromide, or quaternary ammonium bromide to form a different, stable aluminum-cationic plating species.

The reaction zone 10 of the FIGURE includes one or more reactors 12 in which the basic reagents, aluminum, a halide source, and a metallic halide MX have been thoroughly mixed and reacted, as described in Ser. No. 734,677 to form fresh electrolyte 15. The fresh electrolyte 15 is then transferred, by suitable and conventional means, e.g., a pump (not shown) via line 16 into an electrolytic cell 20.

The substrate 22 of cell 20 comprises any electrically conductive material, e.g., titanium, vanadium, alloy 42, Kovar, etc., upon which aluminum is to be plated. The substrate 22 now becomes the cathode 22 of cell 20.

However, the preferred cathode 22 is a metallic substrate. The terminal 24 now becomes anodic. The anode 24 may be made of aluminum although inert anodes may also be used with excellent results.

The plating chamber 26 of cell 20 is basically an enclosed area that contains the anode and cathode separated at distances of from about 0.030 inch to about 1.000 inch. The electrolyte 15 enters the chamber 26 from the reaction zone(s) 12*a*, 12*b* via line 16. The used or spent electrolyte is preferably continuously withdrawn from the plating chamber 26 by pump $P_1$ after the aluminum cationic plating species has been depleted to some small extent and is then fed via line 32 to a regeneration column 40, packed with fine, activated aluminum*. The aluminum cation plating species is thereby replenished or enriched.

* Activated aluminum is prepared by degreaging 99.9% pure aluminum with a toluene-hexane admixture, washing with KOH, rinsing with water and methanol, and washing in the final solvent used as the reaction solvent.

After passage through the regeneration column 40, the enriched electrolyte may be filtered, e.g., in a combination filter comprising a woven glass bed 52*a*, and a sand bed 52*b*, to remove any suspended aluminum and other contaminants, such as polymers and preferably returned directly to the plating chamber 26 via line 48. If it is desired to introduce some additional fresh electroplating solution from reactors 12*a* and 12*b*, some enriched electrolyte may be held in storage chamber 45 for return to plating chamber 26 by means of pump $P_2$ via lines 47, 48 when required.

Valves $V_1$ and $V_2$ are placed in appropriate lines, as shown, to direct the enriched solution, as desired. The sampling of enriched electroplaing solution, to check increased [Al+3] molarity and/or resistivity, occurs by taking samples, from return line 48.

By following the above procedure, the by-products of plating (halogen and halide) will not accumulate in such large concentrations in the plating chamber 26 such that they will attack either the plated aluminum 50, on the cathode 22 or the solvent (if toluene is used). Thus, as aluminum is being plated onto the cathode 22, the released by-products of plating are directed away from the cathode 22 towards the anode 24 to form new aluminum cation plating species while the remainder of the by-products are trapped by the regenerating column 40 in which the by-products are re-converted to new aluminum cation plating species, thereby replenishing or enriching the solution.

Although the electroplating process described, to this point, is a balanced cycle in which theoretically at least the electrolyte is stable indefinitely and electroplating can be performed indefinitely, the electrolyte may tend to deteriorate after long periods of continuous plating, because of certain considerations set forth in said copending application, Ser. No. 734,679.

Thus, after long periods of plating, it is presently preferred to incorporate into the process syste, abovedescribed, a recirculation of high viscosity, high resistivity electrolyte to reaction vessel(s) 12*a*, 12*b*. This is accomplished by sending deteriorating electrolyte to storage chamber 45 from regenerating bed 40.

More specifically, in response to an appropriate signal from a conductivity probe 53, indicating a high given resistivity (e.g., above 400 ohm/cm) in the electrolyte in storage chamber 45, the electrolyte will be pumped, via pump $P_3$ through open valve $V_4$ and line 54, to a combination filtration bed 55*a*, 55*b* of the same type as filtration bed 52*a*, 52*b*. The high resistivity electrolyte is then sent to reaction zone 12*a* after filtration, via line 56 and treated with fresh solvent, aluminum, MX, and hydrogen halide to synthesize new aluminum cation plating species. After the electrolyte has fully been synthesized, it is again transferred to the cell 20 to enter the plating cycle once again. Alternatively, of course, the deteriorating electrolyte could be discharged from the plating cycle or system, entirely, and completely fresh electroplating solution be made.

EXPERIMENTAL SECTION AND EXAMPLES OF OPERATION OF THE NEW PROCESS i. Introduction In the analyses of the $[H^+]$ and $[Al^{+3}]$ concentrations of the etch solution, the following procedures were followed: In general, one ml. of the etch solution was decomposed into 100 ml. of distilled water using a pressure equalizing funnel and flask. The $[H^+]$ and $[Al^{+3}]$ concentrations were determined by titrating this aqueous solution (1 ml. etch/100 ml $H_2O$) with a standard sodium hydroxide solution up to end points of pH 3.00 and 11.00, respectively.

ii. Preparation of the Novel Etch Solution

The apparatus used in the preparation of the novel etch solution consisted of a 2,000 ml. 3-neck round bottom flask equipped with a reflux condenser connected to a gas trap, hydrogen bromide inlet tube, argon inlet tube, magnetic stirrer, and water bath.

80 g. of aluminum wire were cut into ¼ inch pieces, and washed with aqueous 2N potassium hydroxide water (3 times), methanol (3 times), and toluene or benzene (3 times). Then, the aluminum was placed into the 2,000 ml, 3-neck round bottomed flask under an atmosphere of argon. 550 ml. of reagent-grade toluene was added. Hydrogen bromide gas was bubbled into the mixture with stirring at room temperature until all the aluminum metal went into solution. Since the reaction is exothermic, cooling with a water bath from time to time as necessary to keep the temperature of the mixture below 40° C. After all the aluminum has been dissolved, hydrogen bromide is added continuously to the solution at 500 ml/min. for another 4 hours, at which time the $[H^+]$ concentration of the solution is at, or close to, the saturation point. A sample of the etch solution was withdrawn for analyses of the $[H^+]$ and [Al+3] concentrations using the analytical methods described above. The concentration of $[Al^{+3}]$ in the etch solution is below 3.5M, and the $[H^+]$ concentration is about 1.5M. The etch solution is now ready to be transferred to the plating chamber for use.

iii. Operation of the Precleaning Process

Before each plating operation, the substrate was degreased, in methanol: toluene (1:1), etched in a solution of ⅓ $H_3PO_4$: ⅓ $CH_3COOH$: ⅓ $HNO_3$ for 30 seconds, rinsed with distilled water, and dried.

Using the cell illustrated in the FIGURE, the novel etch solution was transferred by pump into the plating chamber 26. With the substrate 22 connected to the positive terminal of he power source and the terminal 24 connected to the negative terminal (a reversal from that of forward electroplating), the reverse current electrolytic cleaning of the cathode was run at a voltage drop in the order of from 1.0 to 2.0 volts, for varying periods of time from 30 seconds up to 3 minutes depending on the type of substrate and the nature of the etch bath. After the precleaning step, the plating chamber was rinsed with 15 ml of plating electrolyte to purge the chamber free of high hydrogen bromide concentration etch solution. Then fresh plating solution 15 was transferred into the plating chamber, and forward plating proceeded as described previously.

The used etch solution and rinse solution was either discarded completely or returned to the 2,000 ml 3-neck flask which now acts as a storage chamber. Here, more hydrogen bromide was allowed to react with the spent solutions, thus rejuvenating the etch solution for the next plating run. To maintain the high concentration of hydrogen bromide of the etch solution at or near saturation, a steady, continuous stream of HBr is bubbled into the solution at all times, including periods between plating runs.

FURTHER COMMENTS

The reverse current anodic etch precleaning procedure herein described, is preferably completely integrated with the electroplating process, in the following way. The solvent, or solvent mixture, and type of halide of the added hydrogen halide in the etch solution is preferably the same as the solvent or solvent mixture, and halide of the aluminum electroplating solution. Thus, is toluene is the solvent, and hydrogen bromide is the hydrogen halide employed to make the etch solution in the foregoing described manner, then, preferably, the electroplating solution is made up with toluene as the solvent and hydrogen bromide as the hydrogen halide. Of course, the proportions of the etch solution and electroplating solution differ as hereindescribed. It is also possible but not presently preferred to utilize differing solvents and/or hydrogen halide for each of the etch solution and electroplating solution.

It is also entirely feasible to move the substrate to be plated from a pre-cleaning cell to an electroplating cell, under suitable precautions, rather than utilizing the same cell for both pre-cleaning and electroplating.

Various other modifications will become apparent to those skilled in the art. Hence, I intend to be limited only by the claims which follow.

I claim:

1. An anhydrous etch solution, which consists essentially of:

an organic solvent selected from the group consisting of benzene, toluene, carbon disulfide, cyclohexane, dimethyl sulfide, tetrahydrofuran, diiodoethane, toluenecyclohexane (1:1), benzene-cyclohexane (1:1), tetrahydrofuran (THF): benzene (4:1) and toluene-$CS_2$ (3:1);

an aluminum halide present in said solution in an amount such that the aluminum cation concentration of said solution lies above about 2.0 molar but below about 3.5 molar; and a hydrogen halide present in said solution in an amount such that the $[H^+]$ concentration of said solution lies above about 1.0 molar but below the hydrogen halide saturation point of said solution.

2. A method for making an anhydrous etch solution, which consists essentially of:

reacting aluminum with a hydrogen halide selected from the group consisting of hydrogen chloride, hydrogen bromide and hydrogen iodide in the presence of an organic solvent selected from the group consisting of benzene, toluene, carbon disulfide, cyclohexane, dimethyl sulfide, tetrahydrofuran, diiodoethane, toluene-cyclohexane (1:1), tetrahydrofuran (THF): benzene (4:1) and toluene-$CS_2$ (3:1) and in the absence of water, to form an intermediate solution in which the concentration of aluminum cation is from about 2.0 molar to about 3.5 molar; and adding to said intermediate solution sufficient hydrogen halide to form an anhydrous etch solution in which the hydrogen ion concentration lies above about 1.0M but the hydrogen halide level is below the saturation point of said anhydrous etch solution.

3. The anhydrous solution formed by the method of claim 2.

4. A method for precleaning a metallic substrate which comprises:

applying an electrical potential of the order of several volts to said metallic substrate to render said substrate anodic with respect to a cathodic terminal in a precleaning zone, in the presence of an anhydrous etch solution of claim 1; and pre-cleaning said substrate while maintaining the polarity of said substrate as an anode.

5. A method for precleaning metallic substrates which comprises:

applying an electrical potential to said substrate to render said substrate anodic with respect to a cathodic element in a precleaning zone in the presence of an anhydrous etch solution of claim 3; and pre-cleaning said substrate while maintaining the polarity of said substrate as an anode.

6. A method for precleaning a metallic substrate and electroplating same with aluminum which comprises:

applying an electrical potential of the order of several volts of said substrate to render said substrate anodic with respect to an element, rendered cathodic in a precleaning zone in the presence of an anhydrous etch solution as defined in claim 1:

withdrawing said anhydrous etch solution from said precleaning zone after a predetermined period of time;

adding electroplating solution containing a plating aluminum cationic species to said precleaning zone;

reversing the polarity of said substrate and cathodic elements from its polarity during said precleaning; and electroplating aluminum onto said substrate in the presence of said electroplating solution while maintaining the polarity of said substrate as a cathode and said element as an anode.

7. A method for precleaning a metallic substrate and electroplating same with aluminum which comprises:

applying an electrical potential of the order of several volts to said substrate to render said substrate anodic with respect to an element, rendered cathodic, in a precleaning zone in the presence of an anhydrous etch solution as defined in claim 1;

withdrawing said anhydrous etch solution from said precleaning zone after a predetermined period of time;

flushing said precleaning zone with an electroplating solution containing a plating aluminum cationic species prior to electroplating of aluminum onto said substrate;

adding fresh electroplating solution containing a plating aluminum cationic species to said precleaning zone;

reversing the polarity of said substrate and cathodic elements from its polarity during said precleaning; and electroplating aluminum onto said substrate in the presence of said electroplating solution while maintaining the polarity of said substrate as a cathode and said element as an anode.

8. A method for precleaning a metallic substrate and electroplating same with aluminum which comprises:

applying an electrical potential of the order of several volts to said substrate to render said substrate anodic with respect to an element, rendered cathodic, in a precleaning zone in the presence of an anhydrous etch solution as defined in claim 3;

withdrawing said anhydrous etch solution from said precleaning zone after a predetermined period of time;

flushing said precleaning zone with an electroplating solution containing a plating aluminum cationic species prior to electroplating of aluminum onto said substrate;

adding fresh electroplating solution containing a plating aluminum cationic species to said precleaning zone;

reversing the polarity of said substrate and cathodic elements from its polarity during said precleaning; and electroplating aluminum onto said substrate in the presence of said electroplating solution while maintaining the polarity of said substrate as a cathode and said element as an anode.

9. The method of claim 6 wherein said solvent in said anhydrous etch solution and the solvent of said electroplating solution are the same.

10. The method of claim 6 wherein said halide of said anhydrous etch solution and the halide of said electroplating solution are the same.

11. The method of claim 7 wherein said solvent in said anhydrous etch solution and the solvent of said electroplating solution are the same.

12. The method of claim 7 wherein said halide of said anhydrous etch solution and the halide of said electroplating solution are the same.

13. The method of claim 7 wherein said electroplating solution is made by:

reacting a given quantity of aluminum, in the presence of an organic, substantially anhydrous, non-Lewis base solvent, with i. a member of the group consisting essentially of a halogen and a hydrogen halide in a quantity in excess of that required to produce an aluminum halide but below that required to produce a hydrogen ion concentration of less than about 0.5 molor, and with ii. about 0.5–20 mole % metallic halide, based on the initial mole quantity of said aluminum, said metallic halide being selected from the group consisting of the halides of Lithium, Sodium, Potassium, Beryllium, Magnesium and the Ammonium ion, to form a plating solution containing an aluminum cationic plating species having an aluminum ion molarity of below about 7.5 molar.

14. A method for precleaning a metallic substrate and electroplating same with aluminum which comprises:

applying an electrical potential of the order of several volts to said substrate to render said substrate anodic with respect to an element, rendered cathodic, in a precleaning zone in the presence of an anhydrous etch solution as defined in claim 1; and electroplating aluminum onto said substrate in the presence of electroplating solution while maintaining the polarity of said substrate as a cathode and said element as an anode.

* * * * *

UNITED STATES PATENT OFFICE

CERTIFICATE OF CORRECTION

PATENT NO. : 4,126,523

DATED : November 21, 1978

INVENTOR(S) : JACK Y. WONG

It is certified that error appears in the above-identified patent and that said Letters Patent are hereby corrected as shown below:

Column 8, line 31, delete "of" and insert --to--; and

Column 10, line 16, delete "molor" and insert --molar--

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*